US005292404A

United States Patent [19]

Hartan et al.

[11] Patent Number: 5,292,404

[45] Date of Patent: Mar. 8, 1994

[54] PROCESS FOR TRASH REMOVAL OR PITCH-LIKE RESIN CONTROL IN THE PAPER MANUFACTURE

[75] Inventors: Hans-Georg Hartan, Kevelaer; Alfons Landscheidt, Krefeld, both of Fed. Rep. of Germany

[73] Assignee: Chemische Fabrik Stockhausen GmbH, Krefeld, Fed. Rep. of Germany

[21] Appl. No.: 861,156

[22] Filed: Mar. 27, 1992

Related U.S. Application Data

[63] Continuation of Ser. No. 479,306, Feb. 13, 1990, abandoned.

[30] Foreign Application Priority Data

Feb. 18, 1989 [DE] Fed. Rep. of Germany ..... 3905049

[51] Int. Cl.[5] ..... D21H 17/55; D21H 21/02

[52] U.S. Cl. ..... 162/164.6; 162/168.3; 162/199; 162/181.3; 162/DIG. 4; 210/692

[58] Field of Search ..... 162/164.6, 168.3, 168.2, 162/181.1, 181.6, 181.7, 199, DIG. 4, 181.3; 210/691, 692, 679, 680

[56] References Cited

U.S. PATENT DOCUMENTS

| | | | |
|---|---|---|---|
| 3,897,333 | 7/1975 | Field et al. | 162/168.3 |
| 4,021,484 | 5/1977 | Toda et al. | 162/168.2 |
| 4,184,912 | 1/1980 | Payton | 162/DIG. 4 |
| 4,190,491 | 2/1980 | Drennen et al. | 162/DIG. 4 |
| 4,311,805 | 1/1982 | Moritani et al. | 162/168.2 |
| 4,861,429 | 8/1989 | Barnett et al. | 162/DIG. 4 |
| 4,919,757 | 4/1990 | Ohmae et al. | 162/168.3 |

FOREIGN PATENT DOCUMENTS

| | | | |
|---|---|---|---|
| 2360715 | 3/1978 | France . | |
| 57-51899 | 3/1982 | Japan | 162/168.3 |
| 59-173398 | 10/1984 | Japan | 162/168.3 |
| 0228637 | 7/1987 | Japan . | |

OTHER PUBLICATIONS

Billmeyer, "The Textbook of Polymer Chemistry", 3rd Edition, 1984, John Wiley and Sons, pp. 208-210.

Strazdins, E., "Chemical Aids Can Offset Strength Loss In Secondary Fiber Furnish Use", Pulp and Paper, Mar. 1984, pp. 73-77.

Penniman, J. G., "The Importance of Eliminating Anonic Trash", Paper Trade Journal, Apr. 1, 1978, pp. 36-37.

*Primary Examiner*—W. Gary Jones
*Assistant Examiner*—Todd J. Burns
*Attorney, Agent, or Firm*—Sprung, Horn, Kramer & Woods

[57] ABSTRACT

The present invention relates to a process for trash removal or pitch control in the paper manufacture, in which process as agent for the trash removal or pitch control cationic groups containing polymers of 50 to 100%-wt. quaternized dimethylaminopropylmethacrylamide or dimethylaminopropylmethacrylamide and 0 to 50%-wt acrylamide, acrylic acid, methacrylic acid, acrylamidomethylpropanesulfonic acid, are used, which polymers have an intrinsic viscosity of smaller than 150 ml/g. The trash removal or pitch control agent is added to the pulp flow and/or the circuit water in amounts of up to 1%-wt., relative to the dry weight of the paper manufactured.

10 Claims, No Drawings

PROCESS FOR TRASH REMOVAL OR PITCH-LIKE RESIN CONTROL IN THE PAPER MANUFACTURE

This application is a continuation of application Ser. No. 479,306, filed Feb. 13, 1990, now abandoned.

DESCRIPTION

The present invention relates to a process for trash removal or pitch control in the paper manufacture.

During the last decades, the paper industry succeeded in reducing considerably the specific fresh water consumption and the specific waste water amount by concentrating and closing the water circuits in the paper manufacture. Reasons for said concentration, on the one hand is to avoid loss of matter with waste water, on the other hand there are the official requirements with respect to composition and amount of waste water abducted according to the law concerning waste-water emission.

Many new problems have arisen due to this concentration of the water amount. Due to the increased portion of circuit water the temperature within the pulp system partially increases considerably. Thus increased slime formation may result. Higher electrolyte concentrations in the process water lead to earlier corrosion. Due to anaerobic zones within the water cycle, problems in connection with odour may arise.

However, the major problem in connection with concentrating the water circuit is the enrichment of organic substances in the recycled water, the so-called trash or pitch-like resins. According to Auhorn "Wochenblatt für Papierfabrikation 112, 37–48 (1984)" these matter consist of dissolved or colloidally dissolved anionic oligomers or polymers, and non-ionic hydrocolloids. They are formed in the production and processing of cellulose, wood pulp, and waste paper as lignanes or polysaccharides or oligosaccharides deriving from the hemicelluloses. Other trash originates from the anionic auxiliaries used in papermaking.

The concentration of such "water-soluble" substances considerably increases with increasing concentration of recycled water. The circuit water of paper machines is extremely loaded with such trash or pitch-like resins, if wood-containing paper is made.

The trash impairs the paper manufacture in many respects. They influence pulp beating due to less fiber swelling and delayed beating effect, they lead to increased sedimentation within the circuit and the pulp flow of a paper making machine.

Furthermore, deterioration of retention, drainage, sheet formation, as well as paper strength are to be observed. The efficiency of practically all chemical auxiliaries is affected by the pitch-like resins. This is true, e.g., in case of auxiliaries for retention and drainage, wet and dry strength agents, sizing agents, defoamers, bleaching chemicals, and dyes. The trash concentration can become a limiting factor for the cycle concentration.

In former times, the addition of aluminum sulfate was common so that these problems could widely be prevented. The high adsorption capacity of the intermediate Al-complexes effects a relief of the recycled water of inorganic and organic impurities. Due to todays neutral operation, aluminum sulfate used as precipitation and fixing agent can no longer be employed. This also results from the fact that calcium carbonate is presently used as coating and filling pigment due to economic and qualitative considerations.

Due to the increased use of calcium carbonate, the production problems in processing the calcium carbonate containing coating refuse and the waste paper in the acidic range have grown considerably. Thus the problem arose to eliminate the trash from the recycled water of the paper manufacturing factories with simultaneously minimizing the aluminium sulfate formerly used.

First hints to solve this problem are already known. According to Arheilger and von Medvey, "Wochenblatt für Papierfabrikation 114, 958–961 (1986)", highly wood-containing, coated paper is produced using calcium carbonate without the addition of alum. This was achieved by adding polydiallyldimethyl ammonium chloride (PolyDadmac) to the circuit water. However, PolyDadmac does not seem to have all of the positive characteristics as alum. For example, considerable difficulties arose in connection with combatting the formation of slime, which could only be removed by the use of other agents.

Furthermore, in contrast to alum, PolyDadmac also fixed chromophoric substances in such a way that the addition of fixing agents in industrial scale lead to a decrease of whiteness of approximately 1.5 points of whiteness, which resulted in a significant increase of costs for bleaching agents.

Thus, the problem of finding substitutes for aluminum sulfate in the elimination of trash or pitch-like resins, which do not exhibit negative side effects, still remains.

In DE-OS 36 20 065 another method is used: There special drainage, retention and flocculating agents are used, namely high molecular, water-soluble polymers of N-vinylamides, which only exhibit their efficiency in the presence of trash, which contain as accompanying substances phenolic groups containing oligomers and/or polymers of the substances of wood. These special N-vinylamide-polymers thus are insensitive to pitch-like-resins which are always present in the paper manufacture in case of concentrated or closed water circuits.

It is a disadvantage of this method that trash removal does not take place, and in particular that the known commonly used agents in the paper industry, i.e., flocculating-, drainage-, and retention-agents, on the basis of cationic polymers cannot be employed.

It is accordingly an object of the present invention to perform trash removal in a simple and efficient way without having to make use of aluminum sulfate, and wherein the auxiliaries, known and proven per se, on the basis of cationic polymers can be used as drainage-, retention-, and flocculating-auxiliaries without reducing their efficiency.

According to the present invention this object is achieved by the use of polymers (homopolymers and/or copolymers) on the basis of quaternized dimethylaminopropyl (meth-)acrylamides, which polymers are added to the pulp flow and/or to the circuit water, whereby these polymers have an intrinsic viscosity of less than 150 ml/g determined in 10%-wt sodium-chloride solution.

The polymers used according to the present invention advantageously consist of 50 to 100%-wt quaternized dimethylaminopropyl(meth-)acrylamide and 0 to 50%-wt acrylamide, acrylic acid, methacrylic acid, acrylamidomethylpropanesulfonic acid, or of mixtures of these cationic and anionic monomers.

The dimethylaminopropyl(meth)acrylamide is quaternized with the usual and known quaternizing agents, e.g., dimethyl sulfate, dimethyl carbonate, benzyl chloride, methyl chloride, or ethyl bromide.

The polymers are used in an amount of 0.05 to 1%-wt, relative to the dry weight of the paper produced, and in fact applied in addition to the usual auxiliaries, in that they are added to the pulp flow and/or to the circuit water. It is preferred to employ the polymer used as trash remover in an amount of 0.2 to 0.8%-wt, relative to the dry weight of the paper produced.

Advantageously the total amount of polymer added for trash removal can be distributed to several feeders.

Surprisingly, it is achieved by the polymers used according to the present invention that a) the trash contained in the plant water is fixed at the paper fiber and b) the degree of whiteness of the paper such produced is not impaired by the trash adsorption.

The polymers according to the present invention employed as trash removers or pitch control agents are preferably used in neutral operation without the addition of aluminum sulfate. However, it is possible, too, to use these products in combination with aluminum sulfate according the pseudoneutral operation.

The polymers used according to the present invention are of particular advantage in the paper manufacture where the water circuit is closed by more than 90%.

The invention is further illustrated by the following examples which are not construed as limiting:

If not indicated to the contrary, the parts given are always parts by weight.

A) PRODUCTION OF THE POLYMERS

Polymer 1

250 parts of acrylamidopropyltrimethyl ammonium chloride are dissolved in 750 parts of water. A pH-value of 5.0 is adjusted. During purging with nitrogen gas, it is heated to 75° C. After the addition of 0.6 parts of potassium peroxodisulfate polymerisation starts.

The final temperature of 90° C. is achieved within 5 minutes. After cooling, the product has a viscosity of 1050 mPa.s, the intrinsic viscosity amounts to 120 ml/g.

Polymer 2

180 parts of acrylamidopropyltrimethyl ammonium chloride and 180 parts of acrylamidomethylpropanesulfonic acid are dissolved one after the other in 568 parts of water. A pH of 5.0 is adjusted using 72 parts of 45% caustic soda solution.

During purging with nitrogen gas, it is heated to 75° C. After the addition of 0.6 part of potassium peroxodisulfate polymerisation starts. The final temperature of 92° C. is achieved within 10 minutes. After cooling, the product exhibits a viscosity of 860 mPa.s, the intrinsic viscosity amounts to 75 ml/g.

Polymer 3

200 parts of acrylamidopropyltrimethyl ammonium chloride are dissolved in 709 parts of water. After addition of 50 parts of acrylic acid, it is adjusted to pH 5.0 using 41 parts of 45% caustic soda solution. During purging with nitrogen gas, it is heated to 75° C. After the addition of 0.4 part of potassium peroxodisulfate polymerisation starts. The final temperature of 94° C. is achieved within 7 minutes. After cooling, the product has a viscosity of 750 mPa.s, the intrinsic viscosity amounts to 98 ml/g.

Polymer 4

210 parts of methacrylamidopropyltrimethyl ammonium chloride are dissolved in 638 parts of water. After addition of 90 parts of methacrylic acid, a pH of 5.0 is adjusted using 62 parts of 45% caustic soda solution. During purging with nitrogen gas, it is heated to 75° C. After the addition of 0.8 part of potassium peroxodisulfate polymerisation starts. The final temperature of 91° C. is achieved within 15 minutes. After cooling, the product exhibits a viscosity of 890 mPa.s, the intrinsic viscosity amounts to 105 ml/g.

Polymer 5

210 parts of methacrylamidopropyltrimethyl ammonium chloride and 30 parts of acrylamidomethylpropanesulfonic acid are dissolved one after the other in 646 of parts water. After addition of 60 parts of acrylic acid, a pH of 5.0 is adjusted using 54 parts of 45% caustic soda solution. After the addition of 0.8 part of potassium peroxodisulfate polymerisation starts. The final temperature of 94° C. is achieved within 12 minutes. After cooling, the product exhibits a viscosity of 740 mPa.s, the intrinsic viscosity amounts to 88 ml/g.

As comparative polymer a polydimethyldiallyl ammonium chloride having an intrinsic viscosity of 95 ml/g was used in the examinations with respect to technical application.

B) EXAMINATIONS WITH RESPECT TO THE TECHNICAL APPLICATION

As proof of the trash removal or pitch control the following methods are usual:

1. The efficiency of cationic drainage and retention agents is decreased by the anionic trash. After addition of trash remover the drainage and retention efficiency is improved and determined quantitatively.

2. The degree of whiteness achieved in the paper is measured according to DIN 53145. A reduction of whiteness of the paper is effected by fixing certain trash or pitch-like resins and chromophores at the paper fibres.

Naturally the degree of whiteness is highest without control agents; and it is reduced by a considerably lower degree when the trash removers or pitch control agents according to the present invention are used compared with the result when using the comparative substances.

1. Pulp Drainage, Schopper-Riegler-Method

The apparatus used is described in "Zellstoff Papier, 5th edition, VEB publishers, Leipzig, pages 387–388". It was modified in such a way that both discharge ports are emptying into a common receiving vessel. Thus it is achieved that no longer the degree of beating but exclusively the pulp drainage is measured.

A waste paper pulp having a solids content of 4% was used. 3 g oven-dry pulp are diluted with tap water (350 mg/1 $CaCO_3$) to a volume of 300 ml. The fixing agent is diluted to a volume of 300 ml and the pulp suspension is added. The suspension is transferred for three times. Subsequently, the drainage auxiliary is diluted to 400 ml and added to the suspension. Then this system is transferred once and drained in the Schopper-Riegler-apparatus.

The time for 700 ml of drain is determined.

In case of the blank reading the drainage is carried out without control agent and drainage agent; in case of the zero value the trash remover is omitted but drainage auxiliary added.

As drainage auxiliary a 25% cationic polyacrylamide is used.

| Drainage tests Schopper-Riegler (Time in seconds for 700 ml of filtrate) | | | | |
|---|---|---|---|---|
| | | Drainage auxiliary (%) | | |
| | | 0.00 | 0.01 | 0.02 | 0.03 |
| blank reading: | | 255 | | | |
| zero value: | | | 121 | 83 | 67 |
| Trash remover 1: | 0.3% | | 89 | 71 | 59 |
| Trash remover 1: | 0.6% | | 78 | 65 | 54 |
| Trash remover 2: | 0.3% | | 96 | 76 | 63 |
| Trash remover 2: | 0.6% | | 86 | 69 | 57 |
| Trash remover 3: | 0.3% | | 93 | 74 | 62 |
| Trash remover 3: | 0.6% | | 82 | 64 | 57 |
| Trash remover 4: | 0.3% | | 92 | 71 | 61 |
| Trash remover 4: | 0.6% | | 82 | 65 | 55 |
| Trash remover 5: | 0.3% | | 94 | 74 | 63 |
| Trash remover 5: | 0.6% | | 83 | 66 | 56 |
| Comparison: | 0.3% | | 115 | 81 | 65 |
| Comparison: | 0.6% | | 105 | 76 | 61 |

2. Determination of Retention (Britt-Jar-Test)

The apparatus used for the determination of the retention is described in "New methods for monitoring retention", Tappi, February 1976, vol. 59, no. 2, K. W. Britt and J. E. Unbehend. 2.5 g oven-dry pulp (90% wood pulp with 48° S. R., 10% chalk, 60% of which have a particle size of smaller than 2 μm, as 71% slurry are diluted with tap water (350 mg/1 $CaCO_3$) to 400 ml volume. After addition of the trash remover, the suspension is transferred 10 times. Subsequently, the retention auxiliary is added as 0.1% solution and the suspension is transferred thrice. After dilution with water to 500 ml, the suspension is placed into the Britt-Jar-tester and stirred at a rotation of 800 rpm for 15 seconds. Then the discharge valve is opened for 30 seconds under further stirring, and the filtrate is collected. After filtration of the filtrate over a nutsch provided with a "Schwarzbandfilter" the accepted stock which was not subjected to retention is determined by drying. The retention is given as percentage of that portion of accepted stock which did not undergo retention to the total accepted stock.

| Britt-Jar-Test (Retention %) | | | | |
|---|---|---|---|---|
| | | Drainage auxiliary (%) | | |
| | | 0.00 | 0.02 | 0.03 |
| blank reading: | | 48.9 | | |
| zero value: | | | 57.1 | 61.6 |
| Trash remover 1: | 0.3% | | 66.5 | 71.3 |
| Trash remover 1: | 0.6% | | 69.8 | 75.4 |
| Trash remover 2: | 0.3% | | 64.6 | 70.8 |
| Trash remover 2: | 0.6% | | 68.4 | 75.1 |
| Trash remover 3: | 0.3% | | 64.3 | 70.1 |
| Trash remover 3: | 0.6% | | 68.9 | 74.3 |
| Trash remover 4: | 0.3% | | 65.2 | 69.9 |
| Trash remover 4: | 0.6% | | 69.2 | 74.8 |
| Trash remover 5: | 0.3% | | 64.8 | 69.3 |
| Trash remover 5: | 0.6% | | 68.2 | 73.9 |
| Comparison: | 0.3% | | 58.3 | 62.7 |
| Comparison: | 0.6% | | 63.9 | 67.3 |

3. Determination of the Degree of Whiteness a) Sheet Formation

The waste paper pulp having a solids concentration of 4% is diluted with tap water in an amount of 2.5 g oven-dry to a volume of 500 ml. The trash remover or pitch control agent is added in an amount of 0.4%, relative to oven-dry pulp, as a 0.5% solution and stirred for 30 seconds with a magnetic stirrer at 500 rpm. Subsequently, the drainage auxiliary, a 25% cationic polyacrylamide, is added in an amount of 0.03% as 0.01% solution and stirred further for 30 seconds. 4 liters tap water are placed in the sheet former and and is made effervescing by blowing in air. The pulp suspension is now added and is drawn off after mixing.

The surfacing cartboard is applied onto the formed sheet and the sheet is drawn off from the wire. Subsequently, it is dried in the vacuum dryer for 10 minutes followed by oven-drying for 5 minutes. The zero value is obtained without fixing agent.

b) Measurement of Whiteness

Following DIN 53145 the degree of whiteness of the sheets thus made is determined. The measurements were carried out using the Elrepho-apparatus of Messrs. Zeiss, the filter no. 7 having calibrated against MgO.

| Measurement of whiteness degree | |
|---|---|
| | whiteness (%) |
| Zero value | 65.9 |
| Trash remover 1 | 62.8 |
| Trash remover 2 | 63.2 |
| Trash remover 3 | 62.7 |
| Trash remover 4 | 61.3 |
| Trash remover 5 | 61.9 |
| Comparison | 57.3 |

We claim:

1. In the manufacture of paper wherein paper pulp is contacted with water and chemicals resulting in production of by-product trash comprising dissolved or colloidally dissolved anionic oligomers or polymers and non-ionic hydrocolloids, which trash is contained in the water, and the water is re-cycled, the method of preventing excessive build-up of the trash in the recycled water which comprises incorporating into the re-cycled water a polymer consisting essentially of a) 50 to 100%-wt. quaternized dimethylaminopropylacrylamide or dimethylaminopropylmethacrylamide and b) 0 to 50%-wt. acrylamide, acrylic acid, methacrylic acid, acrylamidomethylpropanesulfonic acid, or mixtures of these monomers, the polymer exhibiting an intrinsic viscosity of at most about 100 ml/g as determined in a 10 wt % NaCl solution.

2. The process according to claim 1, wherein the polymer is incorporated in an amount of 0.05 to 1-wt. %, relative to the dry weight of the manufactured paper.

3. The process according to claim 1, wherein the polymer is incorporated in an amount of 0.2 to 0.8-wt %, relative to the dry weight of the manufactured paper.

4. The process according to claim 1, wherein the dimethylaminopropylacrylamide or dimethylaminopropylmethacrylamide is quaternized with dimethyl sulfate, methyl chloride, ethyl bromide, dimethyl carbonate or benzyl chloride.

5. The process according to claim 4, wherein the polymer is incorporated in an amount of 0.2 to 0.8 -wt %, relative to the dry weight of the manufactured paper, without the addition of aluminum sulfate, the total amount of the polymer incorporated is added through a plurality of feeders, and there is also incorporated into the recycled water a known cationic paper auxiliary.

6. The process according to claim 1, wherein the total amount of the polymer incorporated is added through a plurality of feeders.

7. The process according to claim 1, wherein there is also incorporated into the recycled water a known cationic paper auxiliary.

8. The process according to claim 1, wherein the polymer is incorporated without the addition of aluminum sulfate.

9. The process according to claim 1, wherein along with the polymer there is incorporating aluminum sulfate.

10. The process according to claim 1, wherein in the papermaking process the circulation of water is closed up for more than 90%.

* * * * *